United States Patent [19]

Engdahl, Jr.

[11] 4,150,778

[45] Apr. 24, 1979

[54] CARTON WITH POUR SPOUT

[75] Inventor: Arnold B. Engdahl, Jr., Irwin, Calif.

[73] Assignee: Federal Paper Board Company Inc., Montvale, N.J.

[21] Appl. No.: 873,105

[22] Filed: Jan. 30, 1978

Related U.S. Application Data

[63] Continuation-in-part of Ser. No. 824,351, Aug. 15, 1977, abandoned.

[51] Int. Cl.[2] ..... B65D 5/74

[52] U.S. Cl. ..... 229/17 R; 222/528

[58] Field of Search ..... 229/17 R; 222/528, 529

[56] References Cited

U.S. PATENT DOCUMENTS

| | | | |
|---|---|---|---|
| 2,760,708 | 8/1956 | Phillips | 229/17 R |
| 3,178,090 | 4/1965 | Commeil | 229/17 R |
| 3,184,137 | 5/1965 | Mohler | 222/528 X |
| 3,344,972 | 10/1967 | Robinson et al. | 229/17 R |
| 3,438,555 | 4/1969 | LaPierre | 222/528 |
| 4,054,240 | 10/1977 | LaPierre | 229/17 R |

FOREIGN PATENT DOCUMENTS

| | | | |
|---|---|---|---|
| 697712 | 11/1964 | Canada | 229/17 R |
| 919695 | 2/1963 | United Kingdom | 229/17 R |

*Primary Examiner*—Davis T. Moorhead

*Attorney, Agent, or Firm*—Guy A. Greenawalt

[57] ABSTRACT

A carton structure fabricated from a single blank of paperboard or similar foldable sheet material is characterized by a tubular body having hingedly connected sidewalls which are initially folded and connected in flattened relation, with panels at opposite ends of the blank overlying each other and constituting a body sidewall in which the outer wall panel has a tear tab arranged to be torn loose and hinged outwardly when the carton is set up so as to form a dispensing opening while the inner wall panel has an integral portion in which a hinged spout forming member is cut and positioned so that a portion thereof which is secured to the tear tab will be pulled into the dispensing opening and form therein a pouring spout upon outward movement of the tear tab.

8 Claims, 14 Drawing Figures

CARTON WITH POUR SPOUT

This application is a continuation-in-part of Ser. No. 824,351, filed Aug. 15, 1977, is now abandoned.

BACKGROUND OF THE INVENTION

This invention relates to carton structures which are especially adapted for packaging products of a flowable character and is more particularly concerned with improvements in cartons which enable the product to be conveniently dispensed through a relatively small recloseable opening in the wall.

Numerous arrangements have been proposed heretofore for packaging products of a flowable nature which it is desirable to be able to dispense in a convenient manner when the product is needed. For example, some food products such as sugar, salt certain cereals and the like, may be marketed in cartons having a dispensing arrangement. A well-known arrangement comprises a bent metal spout forming member mounted in an aperture in the container wall so as to substantially cover the aperture in a closed position and to hinge to an open position enabling the product to be dispensed through the resulting wall opening. The metal spout member and the labor involved in mounting it in the opening increases substantially the cost of the packaging operation and limits the field of use of such packages. When a sealed opening is required the application of an overlying sealing patch further increases the cost of the packaging operation and discourages the use of this arrangement for packaging a number of products which would be more conveniently handled if marketed in this type package. Also some objections have been raised to the use of the metal spout member which are based on safety hazards and ecology. Some efforts have been made to eliminate the metal spout in paperboard cartons of this type by employing a paperboard insert arranged to be moved to the spout forming position in a dispensing aperture in the carton wall. One such dispensing spout arrangement is shown in U.S. Pat. No. 3,989,171 granted Nov. 2, 1976, to E. L. Arneson. This type arrangement, while producing a satisfactory pouring spout, requires a greater amount of the carton material and more machine operations for fabrication of the carton which results in a higher cost than desired.

A general object, therefore, of the present invention is to provide a carton having an improved pouring spout arrangement which can be produced in a more economical manner than similar arrangements heretofore employed, which is easy to operate and which involves minimum risk of injury to the user.

A more specific object of the invention is to provide a carton formed of foldable paperboard, or similar sheet or web material, with a dispensing arrangement of the pouring spout type which can be readily incorporated in the carton with minimum increase in the amount of material and in the machine operations required to produce the cartons.

A still more specific object of the invention is to provide a dispensing arrangement for incorporation in a carton formed of paperboard or similar foldable sheet material wherein the pouring spout member is taken from an integral portion of a single blank which is cut and scored so as to enable fabrication of the carton in collapsed condition.

Another object of the invention is to provide a carton of paperboard, or similar foldable sheet material, with a dispensing opening which is initially closed by a pouring spout forming member cut at least in part in an extension of a panel which serves to connect the carton wall panels and which is arranged on an inner wall portion and connected to a hinged flap cut in the outer wall panel which flap is adapted to be hinged outwardly so as to manually draw portions of the spout member into the opening and form therein a pour spout for convenience in dispensing the carton contents through the opening.

A further object of the invention is to provide an improved dispensing opening for a carton formed of paperboard, of similar material, wherein the all area for the opening is initially covered by a spout forming member disposed on the inner face of the wall and having a portion adapted to be drawn through a slit in the wall which defines one edge of the opening and which enables the wall area to be freed and hinged so as to form the opening and to enable portions of the inner member to be drawn into the opening and to form therein a pouring spout.

To this end the invention, as claimed herein is embodied in a carton of paperboard or similar foldable sheet material which is adapted to be fabricated in collapsed tubular form and which is provided on the inner face of a wall thereof with a spout forming member derived from an extended portion of a wall connecting member and including a portion thereof arranged so as to be pulled through a slot in the wall which slot defines one edge of a dispensing opening resulting when a tear tab in the wall is pulled outwardly and an area to which the spout member is secured is thereby freed for hinging movement about an edge of the opening so as to pull the spout member into the opening and form therein a pour spout for convenience in dispensing the carton contents through the opening.

The aforesaid and other objects and advantages of the invention will become more apparent when reference is made to the accompanying detailed description of the preferred embodiments of the invention which are set forth therein by way of example and shown in the accompanying drawings wherein like reference numerals indicate corresponding parts throughout:

DESCRIPTION OF THE PREFERRED EMBODIMENTS OF THE INVENTION

Figure 1:
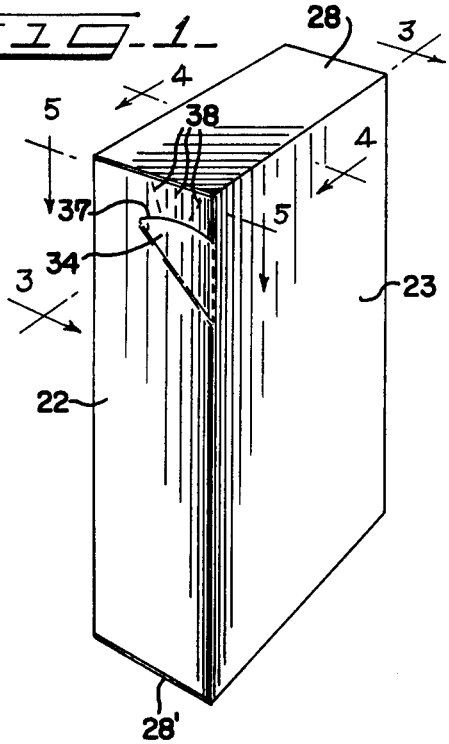
FIG. 1 is a perspective view of a carton in set up and closed position with a dispensing arrangement in the form of a reclosable opening having a pouring spout incorporated therein which embodies the principal features of the invention.

The basic carton structure which is illustrate in the drawings is formed from a paperboard blank of typical construction except for the provision of a tear out area in one sidewall panel at the one end of the blank in which a pouring spout arrangement is to be incorporated and the extension of the sidewall connecting panel at the other end of the blank so as to enable the pouring spout member to be cut therein. In the form illustrated, the pouring spout structure or assembly is incorporated in a sidewall adjacent the top portion thereof and the sidewall panel is cut and scored to accommodate the same. The exact size and shape of the carton and the character of the blank which is cut and creased or shaped to provide the basic carton structure may be viewed considerably. Also it will be understood that the exact location of the pouring spout is a matter which may be dictated, at least in part, by the characteristics of the product which is to be enclosed in the carton and which is adapted to be dispensed through the opening in which the pouring spout is mounted.

Figure 7:
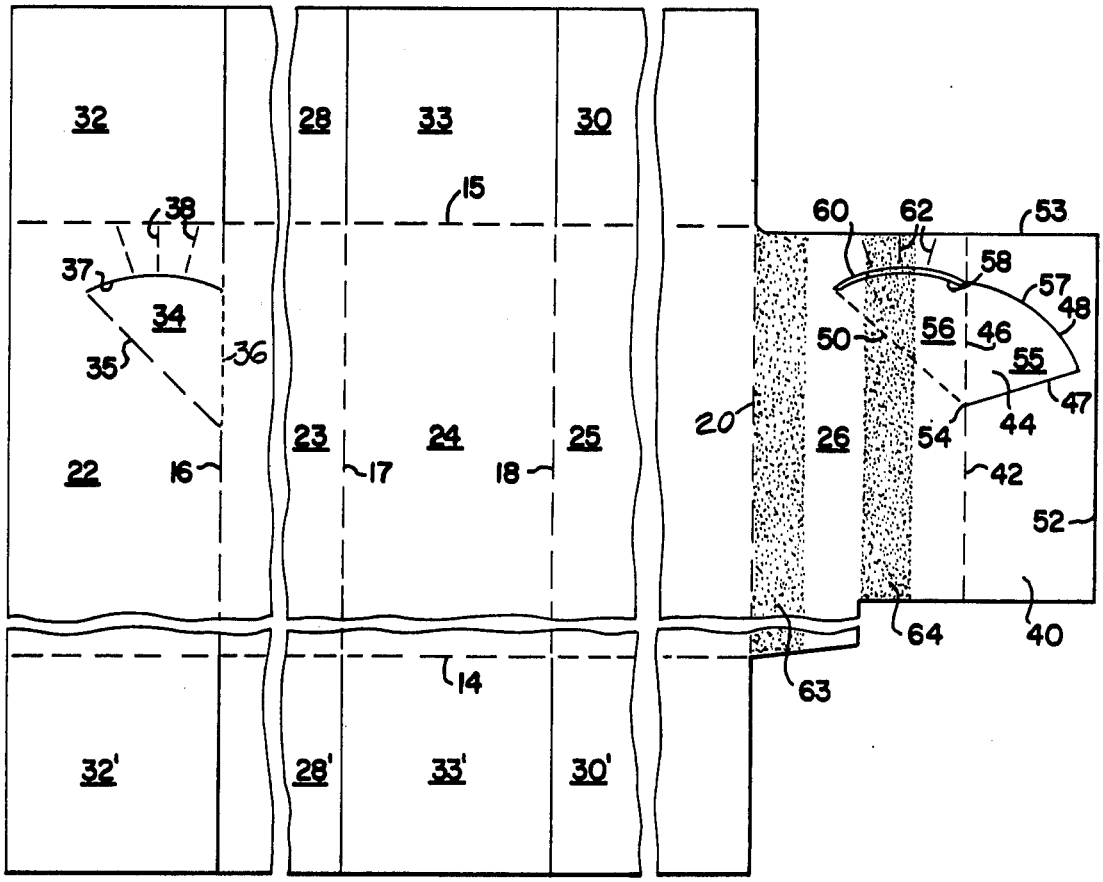
FIG. 7 is a plan view, with portions broken away, of a blank which is cut and scored to provide the carton of FIG. 1.

Referring to the form of the invention illustrated in FIG. 1 of the drawings, the carton 10 may be formed of foldable sheet material, for example, a blank 12 of paperboard stock of suitable weight, the outside face of which is shown in FIG. 7. The blank is cut and scored on laterally spaced lines 14, 15 and longitudinally spaced transverse lines 16, 17, 18 and 20 to provide a foldably connected sidewall panels 22, 23, 24 and 25 and a corner connecting adhesive panel 26. In the form of the carton shown in FIG. 1, which is rectangular in cross section, the sidewall forming panels 23 and 25 have a dimension lengthwise of the blank which is greater than the corresponding dimension of the panels 22 and 24. The blank marginal areas outboard of the score lines 14 and 15 are cut on transverse lines constituting extensions of the transverse score lines to provide top and bottom or end wall structures which comprise closure flaps 28, 30 and 28', 30', extending outwardly of and hinged to the sidewall panels 23, 25 on the score lines 14, 15 at opposite sides of the blank, and cooperating dust flaps 32, 33 and 32', 33' which extend outwardly of and are hinged to the sidewall panels 22 and 24 on the score lines 14 and 15.

The one narrow sidewall panel 22 has provision for a pouring opening or aperture by cutting therein near the top forming edge of the panel a hinged tear flap member 34. The flap member 34 is generally triangular in shape, being defined by the hinge forming crease or score line 35 which extends diagonally upwardly or outwardly of the score line 16, the perforated or weakened tear line portion 36 of the transverse hinge line 16, and the outwardly bowed cutting line 37 which extends between the outermost ends of the score line 35 and tear line 36 and is spaced inwardly at the score line 15. A plurality of score lines 38 extend upwardly in fan-like arrangement above the cutting line 37 so as to weaken the material in this area and permit it to bend inwardly when inwardly directed pressure is applied as hereinafter described.

Figure 8:
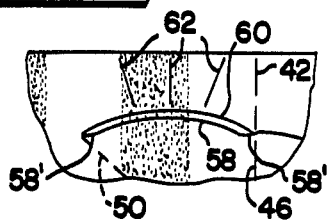
FIG. 8 is a fragmentary plan view showing a portion of the blank of FIG. 7 to an enlarged scale.

The corner connecting panel 26, which has a dimension, in the direction longitudinally of the blank, smaller than the corresponding dimension of the panels 22 and 25, is extended, in the direction longitudinally of the blank, so that the extended portion 40 has a dimension from the score line 20 to the end edge of the blank which is substantially greater than the corresponding dimension of the wall panel 22 at the opposite end of the blank. In the form shown, the extended portion 40 is at the side of the blank which will become the top end of the carton and is designed to lie in part against the panel 22 and in part against the panel 23 which adjoins the panel 22 (FIG. 5) when the wall panels are folded and the connecting flap or panel 26 is secured in underlying relation with the free marginal portion of the wall panel 22. The extended end portion 40 has a transverse hinge score 42 which is parallel with the hinge score 20 and spaced therefrom a distance which is slightly less than the width of the panel 22. The extension panel portion 40 is cut and scored or creased to provide a two part inner spout forming member 44 which extends on opposite sides of the portion 46 of the score line 42 at a predetermined location, transversely of the blank which is determined or controlled by the location of the aperture forming hinge tab 34 in the direction transversely of the blank. The spout forming member 44 is defined by cutting on the lines 47, 48 and perforating or scoring on the line 50. The line 47 is angled outwardly in the direction of the blank end edge 52 and in the direction of the side edge 53, from a point 54 on the transverse score line 42 where it intersects the hinge forming score line 50. The hinge line 50 angles in the direction of the hinge forming transverse score line 20 and the blank side edge line 53, the angle of inclination of hinge forming score line 50 relative to the hinge forming score line 42 corresponding to the angle of inclination of the hinge forming score line 35 relative to the hinge forming transverse score line 16. The score line 42 extends across the spout forming member 44 with the hinge portion 46 dividing the spout member 44 into two panel portions 55 and 56. The cutting line 48 is divided into two outwardly bowed or outwardly curved portions 57 and 58 which define curved edges of the two spout portions 55 and 56, respectively. The material outboard of the cutting line portion 58 is partially cut on a line 60 which is generally parallel with the line 58 and spaced outwardly thereof a short distance. The cutting line 60 which extends only partially through the board material encompasses the flattened end portions 58' (FIG. 8) of the cutting line 58 and extends between the outboard terminal ends of the score line 46 and 50. The area between the cutting lines 58 and 60 is provided for the purpose of sealing the outboard edge of the opening when the carton is fabricated. Spaced, short length score lines 62, are formed in fan-like arrangement in the blank material between cutting line 60 and the side edge 53 of the panel corresponding to the score lines 38 in panel 22 for the same purpose.

Figure 2:
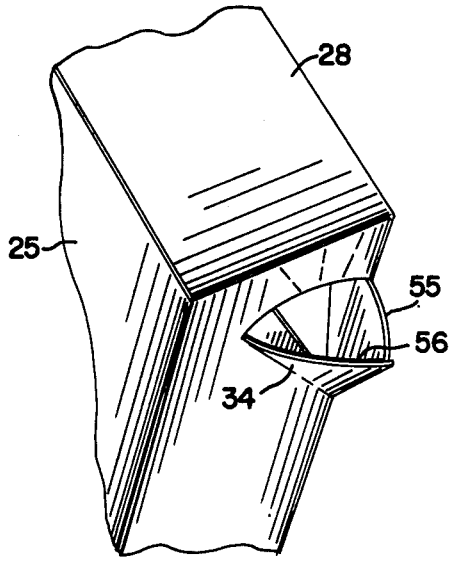
FIG. 2 is a fragmentary perspective view showing the top portion of the carton of FIG. 1 with the pouring spout in an open position.
Figure 3:
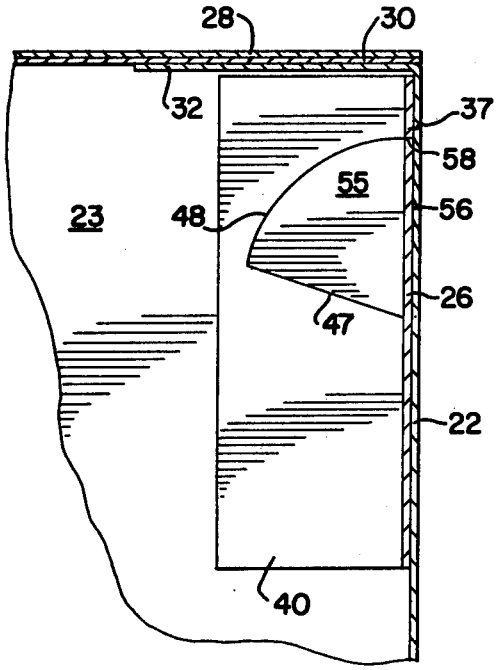
FIG. 3 is a fragmentary cross sectional view taken on the line 3—3 of FIG. 1 to an enlarged scale.
Figure 4:
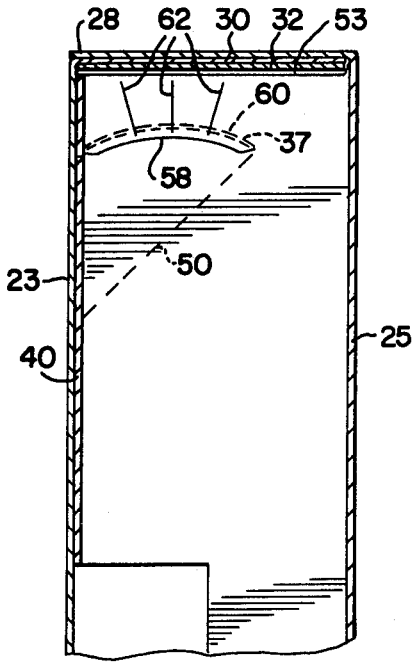
FIG. 4 is a fragmentary cross sectional view taken on the line 4—4 of FIG. 1.
Figure 5:
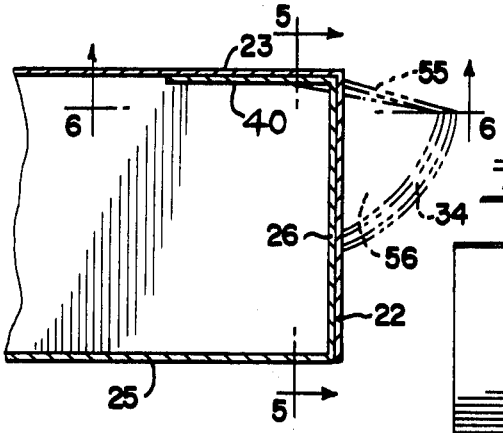
FIG. 5 is a fragmentary cross sectional view taken on the line 5—5 of FIG. 1.

The carton is fabricated in collapsed tubular form by folding the blank on the transverse score lines 20 and 17 so as to bring the extension portion 40 in underlying relation to the panel 22 and portions of panel 23. Prior to the folding, an adhesive is applied to the panel 26 and extension portion 40 as indicated at 63 and 64. The folding on the hinge forming transverse score lines brings the panels into collapsed position with the score line 42 underlying the score line 16 and in approximate alignment with the same. This will align the panel 56 with the panel 34 and with the cutting line 60 substantially aligned with the cutting line 37, so that the panels 34 and 56, which are secured together by adhesive 64, may be pulled outwardly, as illustrated in FIGS. 2 and 5, with the panel 55 sliding along the inside face of the sidewall panel 23. The score lines or cutting lines 38 and 62 permit the wall area adjacent the line 60 to be more easily depressed or pressed inwardly so as to open a slit by tearing the material along the partially cut through line 60 and exposing the edge of the tear flap 34 which may then be easily gripped and pulled outwardly by a suitable tool or the finger nail.

Figure 6:
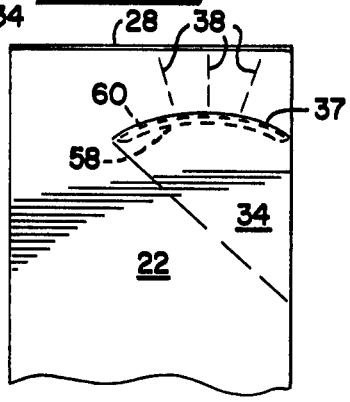
FIG. 6 is an elevational view showing a portion of the outer face of the wall in which the pouring spout in incorporated.
Figure 9:
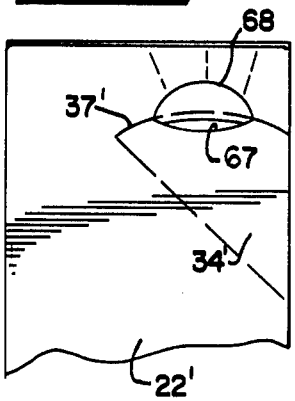
FIG. 9 is a fragmentary elevational view, similar to FIG. 6, showing a portion of the outer face of a carton wall with a modified pouring spout structure.

A modification of the pull tab arrangement is illustrated in FIG. 9 wherein the tear tab or pull tab 34' which is cut in the outer wall panel 22' has a top edge cut on the line 37' with a small portion of the tab below the line 37' cut away on the downwardly bowed line 67. A small portion of the wall area above the line 37' is also cut away on the line 68. The blank for forming the carton is otherwise the same as the blank shown in FIG. 7. The two cut away areas between the lines 67 and 68 serve to expose the portions of the pouring spout member 56 and of the adjoining panel area which would otherwise be covered in the form shown in FIG. 6. This is designed to make it somewhat easier to press in the top portion of the panel adjoining the dispensing opening and to grasp the top edge of the pull tab portion 34 for opening the dispensing aperture. Opening instructions, such as, "PUSH" and "PULL" may be imprinted in the exposed area and on the top margin of the pull tab, respectively.

Figure 10:
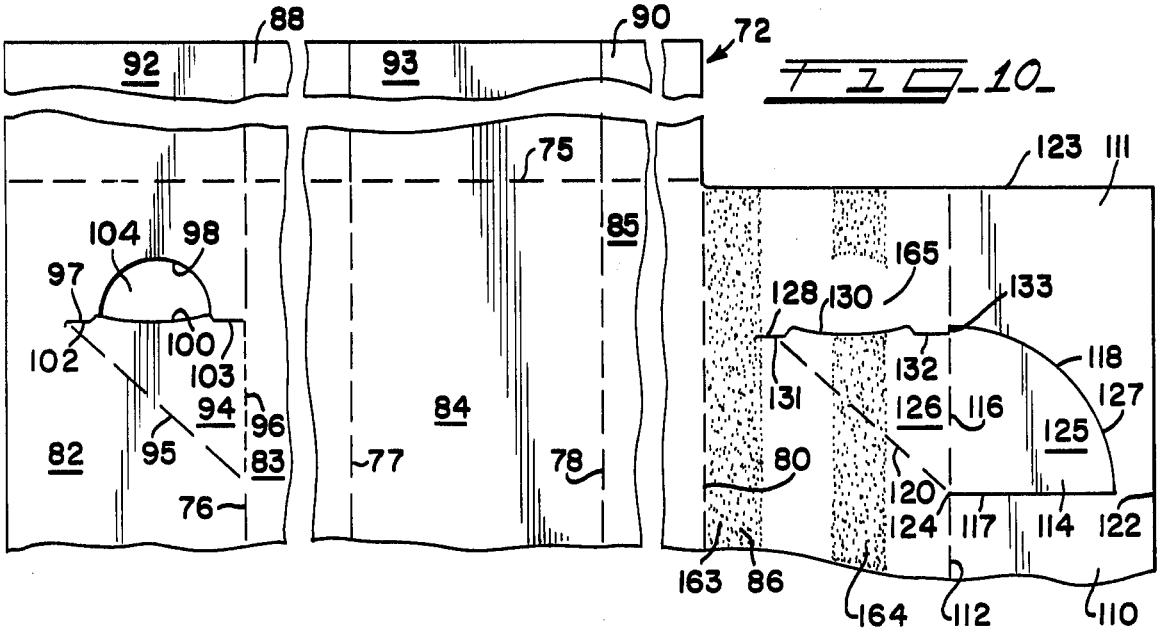
FIG. 10 is a plan view, similar to FIG. 7, showing a portion of a blank which is cut and scored to provide a modified form of the carton.

A further modified form of the carton pour spout arrangement is illustrated in FIGS. 10 to 14. In this form, the basic carton structure may be the same as in the forms shown in FIGS. 1 to 9. A generally rectangular blank 72 is cut and scored as indicated in FIG. 10. The main portion of the blank, which is adapted to form the carton body, is scored on two parallel, transversely spaced, longitudinal lines, one of which is indicated at 75, the other one (not shown) being spaced inwardly of the opposite side margin, in a like manner.

Parallel, longitudinally spaced transverse score lines 76, 77, 78 and 80 cooperate with the longitudinal score lines so as to define hingedly connected sidewall forming panels 82, 83, 84, 85 and a sidewall connecting panel 86. The side marginal portions of the blank 72 are divided by cutting lines forming extensions of the transverse score lines to provide a pair of end closure panels, only one of which is illustrated at 88, 90 with associated dust flaps 92, 93. The one sidewall panel 82 has formed therein a generally triangular shaped pull tab member 94. One side or edge of the pull tab 94 falls along, or coincides with, the score line 76 and is perforated, or otherwise weakened, as indicated at 96, so as to be readily torn. A score line 95, which defines a hinge forming edge of the tab 94, extends at an angle from the inboard end of the tear line 96 to the one end of a cutting line 97 which extends in the direction longitudinally of the blank to the outboard end of the tear line 96. A semi-circular cutting line 98 which is disposed intermediate the ends of the cutting line 97, is bowed in the outboard direction and defines, with the central portion 100 of the cutting line 97, a semi-circular area 104 which is punched out. The cutting line portion 100 is bowed in the direction inboard of the side edge of the blank. Opposite end portions 102 and 103 of the cutting line 97 are aligned and extend generally normal to the tear line 96 with the intersection of these end portions and the ends of the cutting line portions 98 and 100 being offset a small distance in the direction of the adjacent outboard side of the blank. The pull tab forming triangular panel 94 is located a predetermined distance from the score line 75 which defines the top edge of the sidewall panels when the bulk is folded to form the carton structure. At the opposite end of the blank, the sidewall connecting panel 86 is extended at the side of the blank which is adapted to form the top portion of the carton, the extended portion being indicated at 110. The extended panel portion 110 is divided by a transverse score line 112, which is parallel with the score line 80 and spaced therefrom a distance which is slightly less than the corresponding distance from the transverse score line 76 to the opposite end edge of the blank, which dimension determines the width of the sidewall forming panel 82. The panel portion 110 is cut and scored to provide a two part inner spout forming member 114, which extends on opposite sides of the portion 116 of the transverse score line 112, at a predetermined location, transversely of the blank which is determined or controlled by the location of the aperture forming hinge tab or pull tab 94 in the direction transversely of the blank. The spout forming member 114 is defined by cutting on the lines 117 and 118 and perforating or scoring on the line 120. The cutting line 117 extends in the thermal portion 111 of the panel 110, normal to the score line 112 and in the direction of the blank end edge 122, from a point 124 on the score line 112 where it intersects the score line 120 to an intersection with the inboard end of the curved cutting line 118, the latter extending in the direction of the side edge 123 of the panel portion 110. The hinge forming score line 120 extends from the transverse score line 112 in the direction of the transverse score line 80 and the outboard edge 123 of the panel portion 110 at an angle which corresponds to the angle of inclination of the hinge line 95 relative to the transverse score line 76. The score line 112 extends across the spout forming member 114 with the hinge forming portion 116 dividing the member into two portions 125 and 126 and dividing the cutting line 118 into two portions 127 and 128. The cutting line portion 127 is in the form of a segment of a circle while the cutting line portion 128 has a configuration corresponding to the configuration of the cutting line 97 with an inboard curved central portion 130 and offset end portions 131 and 132. The cutting line portion 128 is generally normal to the transverse score line 112 in the same manner as the cutting line 97 so that when the carton is formed with the panel portion 110 lying along the inside faces of the panels 82 and 83, the top forming curved edge of the sliding inner spout panel 125 will extend above the top edge of the hinged inner spout panel 126, which is defined by the cutting line portion 132, and the top margin of panel 125 will ride in a small slot 140 (FIGS. 12 and 13) formed between the short edge portion 133 of the material at the end of cutting line portion 132 and the inside face of the extension panel portion 111 at the hinge line 116.

Figure 11:
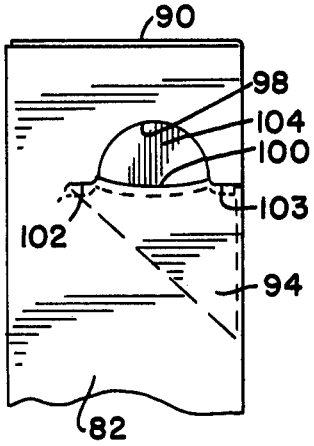
FIG. 11 is a fragmentary elevational view showing the top portion of the outer face of the wall of the carton which is formed with the blank of FIG. 10 and in which the pouring spout is incorporated.
Figure 12:
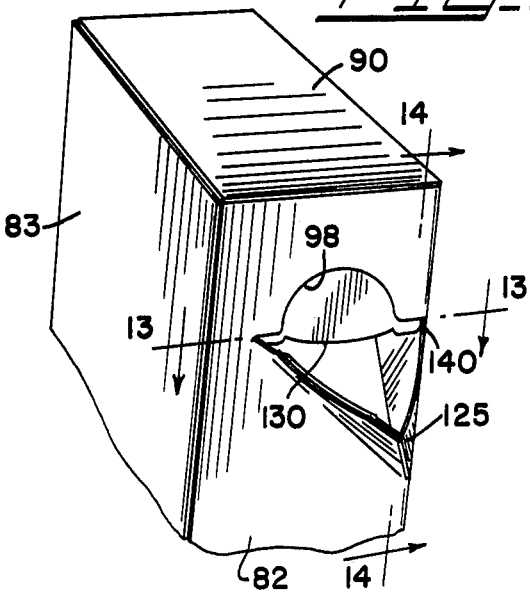
FIG. 12 is a fragmentary perspective view showing the carton of FIG. 11 with the pouring spout in an open position.
Figure 14:
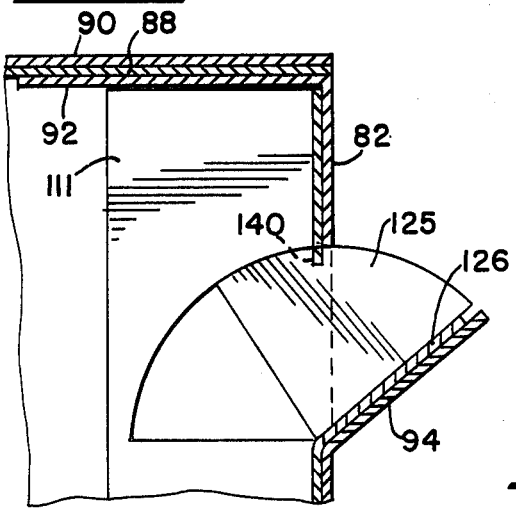
FIG. 14 is a fragmentary sectional view taken on the line 14—14 of FIG. 12, to an enlarged scale.
Figure 13:
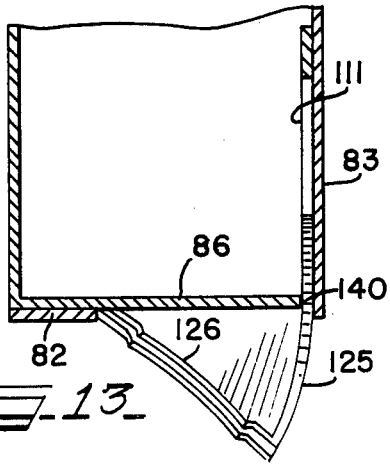
FIG. 13 is a fragmentary cross sectional view taken on the line 13—13 of FIG. 12 to an enlarged scale.

The cut and scored blank 72 is folded with the panels hinged to each other in the same manner as described with respect to the blank 12 which is shown in FIG. 7. An adhesive is applied to the connecting panel 86 and the adjoining portion of extension 110, the adhesive strips being indicated at 163 and 164, with the latter interrupted to leave an adhesive-free area 165. The folding of the panels on the score lines 80 and 76 brings the wall connecting panel 86 and that portion of the extension panel 110 which includes the pour spout panel 126, into engagement with the inner face of the sidewall panel 82 (FIG. 13) with the adhesive strip 163 (FIG. 10) serving to connect the sidewall panels and the adhesive 164 connecting the panel 126 to the pull tab panel 94, under which it lies, while the portion 111 of the extension panel 110 which includes the spout-forming panel 125, will be against the inside face of the sidewall panel 83 which adjoins the panel 82. As shown in FIG. 11, the top edge of the inner spout member 126 lies a short distance below the cutting line 100, 102, 103 which defines the top edge of the pull tab panel 94 so that there is no opening initially. The opening 104 in the panel 82 exposes the top edge of the pull tab panel 94 so that a finger nail may be inserted beneath the marginal edge of the same for exerting an outward force to pull the tab 94 open which will draw the hinged panel 126 into the resulting opening in the sidewall 82 and along with it the sliding panel 125, the top margin of which rides in a slot 140 (FIGS. 12 to 14) formed between the end edge 133 of panel portion at the cutting line portion 132 as a result of the offsetting of the cutting line portion 132 relative to the end of the curved cutting line portion 127, which slot 140 serves as a guide or track for holding the spout panel 125 in a path along the inside face of the sidewall panel 83.

What is claimed is:

1. An elongate blank of paperboard, or similar foldable sheet material, which is cut and scored to form a tubular carton, said blank being divided into a series of sidewall forming panels by longitudinally spaced, parallel, transverse hinge forming score lines, with a panel at one end of the blank being adapted to be folded into underlying relation with the sidewall forming panel at the opposite end of the blank and to be secured thereto so as to form a sidewall connecting panel, said sidewall forming panel at said opposite end of the blank having a generally triangular shaped pull tab formation defined by a hinge forming score line of predetermined length extending diagonally of said panel from a point on a transverse score line which defines one end of a tear line portion of the hinge forming score line between said sidewall panel and the adjoining sidewall panel and a cutting line which extends from the outboard end of said hinge forming score line across said panel to a point on said transverse score line which is spaced a predetermined distance from said first mentioned point on said transverse score line, the portion between said spaced points constituting said tear line and said cutting line defining the outboard edge of said pull tab, said sidewall connecting panel having a panel portion extending in the direction longitudinally of the blank with a transverse score line which is spaced from the hinge score line a distance corresponding to the dimension of the sidewall panel in the longitudinal direction at the opposite end of the blank and an inner spout forming member cut in said connecting panel portion which is divided into two generally triangular shaped sections by a hinge forming score line extending transversely of the blank and coinciding with said transverse score line in said extension panel portion, with one of said sections having a configuration corresponding to the configuration of said pull tab formation and positioned in said extension panel portion so that when the sidewall panels are folded and connected, in forming the carton, said one section of said inner spout member will be disposed substantially in registry with and lie against the inside face of said pull tab formation while said associated triangular section will lie against the inside face of the adjoining sidewall panel.

2. An elongate blank as set forth in claim 1 wherein said cutting line which defines the outboard edge of said pull tab is spaced inwardly of an adjacent longitudinal score line, which defines the end edges of the sidewall forming panels, a lesser distance than a corresponding cutting line which defines the outboard edge of said one section of said inner spout forming member, said cutting lines having relatively short offset portions at the ends of said lines which terminate at said transverse score lines.

3. A tubular carton structure formed from a single blank of paperboard or similar foldable sheet material which is cut and scored to provide a series of integral sidewall forming panels, a sidewall connecting panel at one end of the blank and associated end wall forming closure panels extending along opposite sides of the blank, said sidewall forming panels being connected in tube forming relation by said sidewall connecting panel which is secured in underlying relation to a margin of the sidewall forming panel which is derived from the opposite end of the blank and which constitutes an outer panel of the pour spout bearing sidewall, said sidewall connecting panel having an integral panel portion extending in the direction of the end of the blank in which panel portion there is cut a pouring spout member of generally triangular configuration, said pouring spout member being divided into two hingedly related triangular panel portions, one of which panel portions is disposed, when said sidewall panels are connected, so as to lie against the inside face of said outer sidewall panel to which said sidewall connecting panel is secured, said outer sidewall panel having an opening tab formation of triangular shape cut therein to hinge on a line substantially coinciding with the corner forming hinge line connecting said outer sidewall panel to the adjoining sidewall and said inside pouring spout panel portion being disposed to register with said opening tab formation which is cut and scored in said associated outer sidewall panel and to be secured thereto, the other one of said two hingedly related triangular panel portions of said pouring spout member being disposed so as to lie along the inside face of the sidewall which adjoins the sidewall panel having said opening tab formation so as to enable said opening tab to be gripped and swung to an open position and to cause said triangle portion of said pouring spout member which is secured thereto to be moved into spout forming position in the opening in said outer sidewall panel which results from swinging said opening tab to an open position while said other end of said triangular panel portions moves into said opening along a path on the inside face of said adjoining sidewall.

4. A carton structure as set forth in claim 3 wherein said outer sidewall panel has an area adjoining a cut edge of said opening tab formation which is weakened so as to enable the area to be readily depressed inwardly and thereby provide access to the edge of the opening tab formation for gripping the same so as to swing it to an open position.

5. A carton structure as set forth in claim 3 wherein said opening tab formation includes an edge defined by cutting on a line of predetermined length with the cut extending through the sidewall panel and said pouring spout member is of a size relative to the size of the opening tab formation and is positioned so that the slit resulting from the cutting of the panel material to define said opening tab edge is covered by an area of the connecting panel extension which may be torn loose when the pouring spout member is moved to open position.

6. A carton structure as set forth in claim 3 wherein said inner pouring spout member is cut in said extended panel portion and said extended panel portion is positioned relative to said tear tab member so that a portion thereof covers the slit area of said tear tab member and seals the opening slit resulting from the cutting of said tear tab member in said outer sidewall member.

7. A carton structure as set forth in claim 3 wherein said other one of said triangular panel portions of said pouring spout member has its top marginal edge confined in a guide slot formed at the inner face of said adjoining sidewall panel so as to be held in said path on the inside face of said adjoining sidewall.

8. A carton structure as set forth in claim 7 wherein said guide slot is formed between an exposed edge of said inside pouring spout panel portion and the portion of the inner face of the adjoining sidewall panel which said exposed edge confronts.

* * * * *

UNITED STATES PATENT OFFICE

CERTIFICATE OF CORRECTION

Patent No. 4,150,778 Dated April 24, 1979

Inventor(s) Arnold B. Engdahl, Jr.

It is certified that error appears in the above-identified patent and that said Letters Patent are hereby corrected as shown below:

Column 2, Line 12, "all" should be --wall--

Column 3, Line 35, "viewed" should be --varied--

Column 6, Line 39, "thermal" should be --terminal--

Signed and Sealed this

*Eighteenth* Day of *September 1979*

[SEAL]

*Attest:*

*Attesting Officer*

LUTRELLE F. PARKER

*Acting Commissioner of Patents and Trademarks*